United States Patent [19]

Nabhan

[11] 4,060,186

[45] Nov. 29, 1977

[54] METAL STRIP HANDLING APPARATUS AND METHOD

[75] Inventor: George A. Nabhan, Chesterton, Ind.

[73] Assignee: National Steel Corporation, Pittsburgh, Pa.

[21] Appl. No.: 629,124

[22] Filed: Nov. 18, 1975

[51] Int. Cl.[2] ..... B65H 17/20; B65H 23/14

[52] U.S. Cl. ..... 226/1; 226/3; 226/118; 226/178; 226/186; 226/192; 226/195

[58] Field of Search ..... 226/1, 3, 25, 15, 38, 226/39, 42, 118, 178, 192, 195, 186

[56] References Cited

U.S. PATENT DOCUMENTS

| | | | |
|---|---|---|---|
| 2,454,021 | 11/1948 | Wilson | 226/186 |
| 3,098,432 | 7/1963 | Bechtold et al. | 226/195 X |
| 3,490,669 | 1/1970 | Watson | 226/176 |
| 3,667,664 | 6/1972 | Schroeder | 226/42 X |

OTHER PUBLICATIONS

"Lorig-Aligner Self Centering Rolls", United States Steel, 8-1957, pp. 5-15.

*Primary Examiner*—Bruce H. Stoner, Jr.
*Attorney, Agent, or Firm*—Shanley, O'Neil and Baker

[57] ABSTRACT

A strip handling apparatus and method which prevent slipping and weaving of strip in strip tensioning units and achieve close control of tension on strip entering a drag strip tensioning unit and leaving a drive strip tensioning unit.

13 Claims, 4 Drawing Figures

METAL STRIP HANDLING APPARATUS AND METHOD

BACKGROUND OF THE INVENTION

In strip handling apparatus, such as that preceding and following steel strip continuous annealing furnaces, closely controlled tension must be maintained on the strip entering and leaving the furnace because of diminution in tensile strength of the strip at annealing temperatures. Additionally, the hundreds of feet of steel strip in the continuous annealing furnace, depending on the type of steel, elongates at an average rate of about 1.2 inches per 100 feet of strip for each 180° F. rise in temperature.

A conventional continuous annealing line is described and illustrated in the MAKING, SHAPING AND TREATING OF STEEL, published by United States Steel Corporation, 9th Edition at page 977. In this type of line the tension on the strip in the annealing furnace is controlled by having a free-hanging loop of strip ahead of the furnace and a free-hanging loop of strip following the furnace in relation to strip movement, with a drag tensioning roll or bridle roll unit at the strip exit side of the first loop for exerting controlled tension on the strip going to the furnace and a drive tension roll or bridle roll unit on the strip entry side of the second loop for pulling the strip through the furnace. The tension unit that pulls the strip through the furnace is driven by speed regulated or controlled electrical motors and the tension unit ahead of the furnace is connected to current controlled electrical generators which control the tension on the strip between the two tension units. The tension or bridle roll units incorporate a series of rolls around each of which the strip passes and each of these rolls acts to increase or decrease the tension on the strip approaching that roll. It will be apparent from the schematic diagram appearing in the aforementioned publication that the strip passing through the tension or bridle roll unit ahead of the furnace will have additional tension placed on the strip as the strip passes over each of the rolls in the tension unit with the tension placed on the strip by the final roll in the tension unit being the tension on the strip throughout the annealing furnace and up to the first roll in direction of strip travel of the tension roll unit following the furnace. This same phenomenon is reversed in the tension unit following the furnace.

In respect to each of these tension roll units, the strip entering the one ahead of the furnace from the free-hanging loop and the strip leaving the one following the furnace and entering the free-hanging loop can have appreciable tension on it by virtue of the weight of the strip in the respective free-hanging loop. The amount of strip in each loop keeps varying depending upon many factors but the important result in respect to the present invention is a resulting varying tension placed on the strip entering the tensioning roll unit ahead of the furnace and leaving the tensioning roll unit following the furnace. This varying tension adversely influences control of the tension on the strip being delivered from the former tension roll unit and on the strip entering the latter tensioning roll unit while at the same time introducing forces in the tensioning units which tend to cause strip slippage and strip weaving on the rolls of the tensioning units.

In the conventional strip handling line such as that illustrated in the aforementioned publication, the motors of the driving tension unit and the generators of the drag tension unit are in each case interconnected electrically so as to act in one case as a drive unit and in the other as a drag unit. As a result, under a given condition of strip gage, strip width and strip speed motor in the drive unit adds a controlled measure of tension to the strip backward relative to strip travel from the associated free hanging loop and each roll of the drag tension unit does the same forward relative to strip travel from the associated free hanging loop, whereby the varying weight of the strip in each free hanging loop is added to or subtracted from the desired tension to the detriment of accurate control of the tension and efficient strip tracking.

ABSTRACT OF THE INVENTION

The purpose of the present invention is to eliminate the foregoing free-hanging loop problems from strip handling lines and this is accomplished in one instance by having; auxiliary roll means interposed between the free-hanging loop and the strip tensioning roll means at the strip entry end of the furnace, the auxiliary roll means being arranged to make continuous surface contact with the strip over an appreciable circumferential surface area of the auxiliary roll means; a drag generator means independent of the tensioning roll unit drag generator means connected to the auxiliary roll means for placing back tension on the strip entering the strip tensioning roll means; and control means associated with the independent drag generator means for maintaining by means of the auxiliary roll means a desired back tension on the strip entering the strip tensioning roll means which is independent of the weight of the strip in the loop. Further to assure efficient operation of the auxiliary roll means in its function, there can be pressure roll means for contacting the strip and pressing the strip against the auxiliary roll means in the area of strip contact with the auxiliary roll means at a point adjacent to the point where the strip leaves the auxiliary roll means, the amount of pressure exerted by the pressure roll means being controlled by power actuated means. In order to act most effectively the pressure roll means can engage only an intermediate portion of the width of the strip not less than the narrowest strip and not greater than about one-half the width of the widest strip handled. The auxiliary roll means can be a rubber covered roll having a plurality of spaced circumferential slits or slots in the periphery thereof in the outer portions of the roll.

The present invention further contemplates the method steps involved in utilizing certain of the means described above to achieve elimination of the free-hanging loop problems.

The present invention is applicable to the entry and exit end or either of any free-hanging loop in a strip handling line of any character, whether or not the strip treatment means requires close control of tension, because the present invention eliminates slippage and weaving of the strip passing through the line.

DESCRIPTION OF THE PREFERRED EMBODIMENTS OF THE INVENTION

Figure 1:
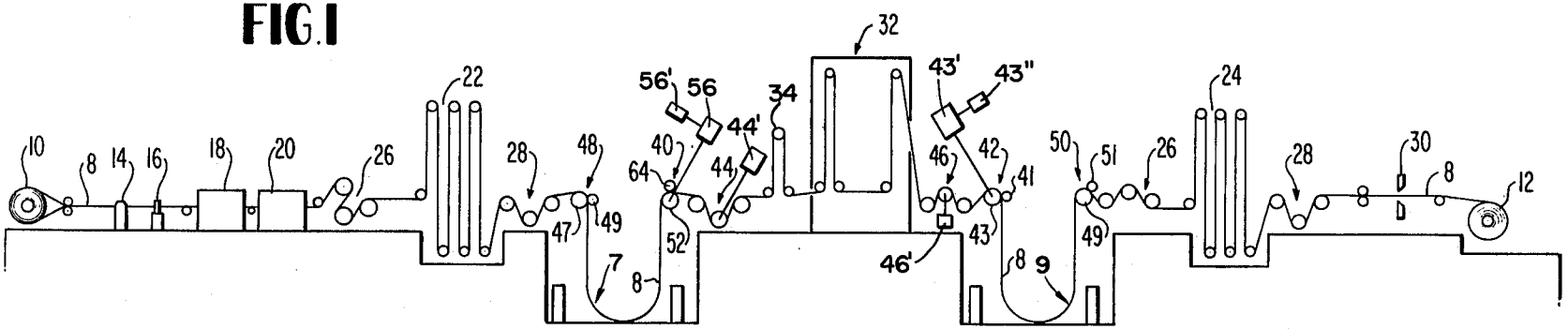
FIG. 1 is a schematic diagram of a continuous strip treating line incorporating the preferred embodiment of the present invention.

Referring to FIG. 1, a metal strip handling line for subjecting metal strip 8 to a desired treatment, such as annealing in the case of steel strip, is illustrated which incorporates the present invention. A strip uncoiler is shown at 10 and a recoiler at 12. A welder for connecting the tail end of one coil to the head end of the next coil to be treated is shown at 14. The necessary shear is shown at 16, a cleaner at 18 and a scrubber at 20. Strip accumulating towers are shown at 22 and 24 at opposite ends of the line for accumulating strip during the shearing and welding operations, each tower being preceded and followed by the usual tensioning units 26 and 28, respectively. The usual shear at the recoiler end of the line is indicated at 30.

The specific environment of the present invention is the apparatus preceding and following the strip treating apparatus indicated generally at 32, for example, a continuous steel strip annealing furnace which is indicated diagrammatically. Movable roll means 34 is shown at the entrance side of the strip treating apparatus for temporarily taking up excess length of strip resulting from thermal expansion during periods when the furnace is starting up or the over-all temperature of the strip is changing and the expansion of the strip due to temperature is rapid; this is necessary to avoid weaving and slippage of the strip in the furnace.

The heart of the present invention resides in the roll arrangements indicated generally at 40 and 42 immediately following and preceding free-hanging strip loops 7 and 9, respectively, taken in combination with adjacent conventional tension roll units, the drag tension roll unit being indicated diagrammatically at 44 and its associated drag generator 44′ and the pull or drive tension roll unit being indicated diagrammatically at 46 and its associated drive motor at 46′. However, the invention and some of its advantages also reside in the similar roll arrangements indicated generally at 48 and 50 which are adjacent conventional tensioning roll units 28 and 26, respectively.

Figure 2:
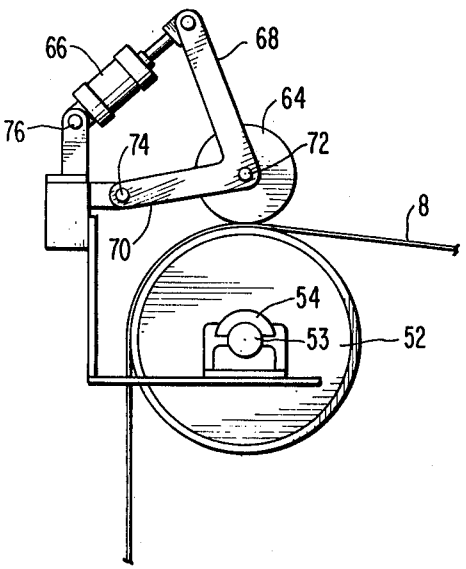
FIG. 2 is an enlarged fragmentary view in side elevation of a portion of the line of FIG. 1.
Figure 3:
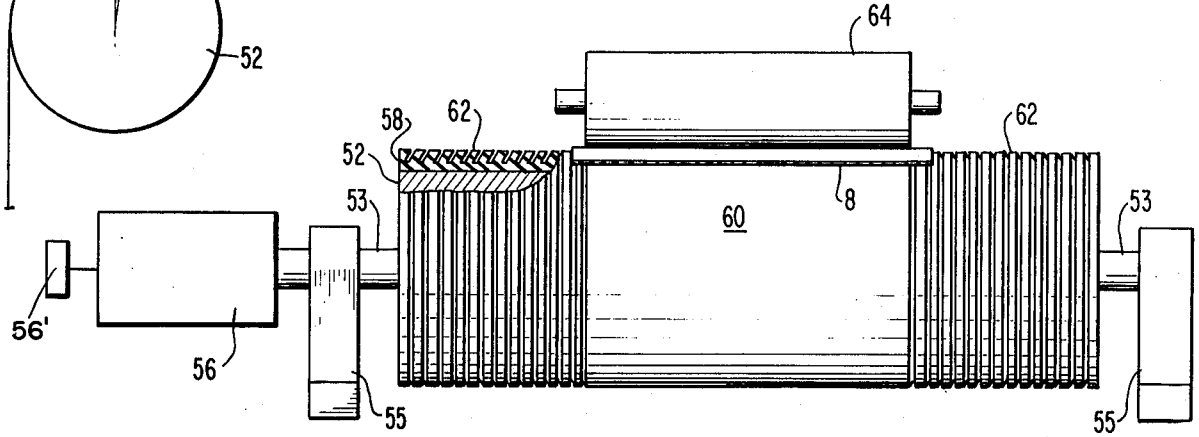
FIG. 3 is an enlarged fragmentary view in end elevation of the structure of FIG. 2.

Referring now to FIGS. 2 and 3, enlarged fragmentary views of roll arrangement 40 show more specifically novel features of those parts of the present invention, although the principles involved apply equally to roll arrangements 42, 48 amd 50. Roll 52 rotates on shaft 53 in bearing 54 supported by members 55, 55. Shaft 53 is connected to a drag generator indicated diagrammatically at 56 which is loaded and controlled by control means indicated diagrammatically at 56′ so as to generate at a chosen strip speed a desired constant amount of current corresponding to a desired tension on the strip passing over roll 52. In other words, electrical controls on this generator are designed to be manually set to determine, independently of the electrical controls of tension roll unit 44, the tension applied to the strip leaving roll 52 and maintain it constant despite variations in the weight of strip 8 in loop 7. The electrical circuits necessary for this generator control are within the realm of a person skilled in the art once the desideratum is made known.

Roll 52 is rubber covered as shown at 58 with the central portion 60 of the rubber covering being of solid configuration and the outer portions 62, 62 being slit or slotted as shown. The slotting 62, 62 in this roll is of the type and for the same purpose as that of U.S. Pat. No. 2,592,581, the purpose being to urge strip passing around the roll toward the central portion of the roll. Unlike the roll of U.S. Pat. No. 2,592,581, the portion 60 of the roll intermediate slotted portions 62, 62 forms with the peripheral surfaces of portions 62, 62 a cylindrical surface or where desired the roll may be convexly contoured over its width to give in a crowned configuration. Intermediate portion 60 of roll 52 has a longitudinal dimension slightly greater than the width of the narrowest strip processed by the line, for example 18 inches. Since roll 52 acts in conjunction with the rolls of a conventional tension or bridle unit, roll 52 is herein referred to as an auxiliary roll.

Associated with roll 52 is a pressure roll 64 which is also preferably rubber covered but entirely with solid rubber. Pressure roll 64 is arranged to press strip 8 against the periphery of portion 60 of roll 52, the amount of pressure being determined by twin hydraulic cylinders 66 acting on opposite ends of pressure roll 64 through twin lever arms 68 and 70, roll 64 being journaled at its ends at 72 at an intermediate point in each lever. The lever arms are pivoted on any suitable support at pivot points 74. In view of the rigid relationship of lever arms 68 and 70, the anchored end of hydraulic jack 66 is pivoted at 76. The necessary controls are associated with jack 66 so as to impose any desired pressure on strip 8 by roll 64. The total pressure on roll 64 should not exceed 200 pounds in order to attain optimum strip tracking.

Figure 4:
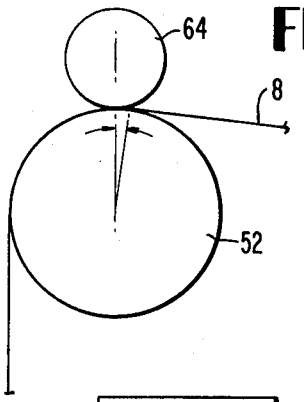
FIG. 4 is a diagrammatic view illustrating certain relationships present in FIG. 2.

It is essential that strip 8 make sufficient contact with the surface of roll 52, taken with the pressure of pressure roll 64 so that strip 8 does not slip on roll 52. Strip wrap around of 90°or more is desirable. An important feature of the present invention is that pressure roll 64 contacts strip 8 at a point as far as practicable from where the strip first contacts roll 52 and adjacent to but slightly removed from the point at which the strip leaves the surface of roll 52. This is shown in FIG. 4 where with a wrap around of slightly more than 90°, the point of contact of roll 64 with the strip is shown at about 3° from the point at which the strip leaves roll 52. This point of contact can be as close as 1° from the point at which strip 8 last makes contact with the surface of roll 52 and can be at any point in between the 1° and for example 10°.

All the foregoing description of the roll arrangement shown in FIGS. 2 to 4 applies equally to roll arrangement 42 in FIG. 1 except that in the latter case, the pressure roll 41 corresponding to roll 64 is in the position shown in FIG. 1 since that is the point adjacent to but slightly spaced (1°–10°, preferably 3°) from the point at which the strip 8 last contacts the surface of the auxiliary roll 43 corresponding to roll 52. In the roll arrangement 42, a drive motor indicated diagrammatically at 43′ and control means therefor indicated diagrammatically at 43″ take the place of the drag generator of roll arrangement 40 in FIGS. 2 to 4. Here again the drive motor is excited and controlled so that a constant desired tension is applied to strip 8 as it comes off the last roll of tension unit 46 and comes into contact with the auxiliary roll regardless of the weight of the strip 8 in loop 9 which variable weight therefore does not influence the tension applied backwardly on tensioning roll unit 46. In this instance the pressure on roll 41 should not exceed 1000 pounds to assure strip tracking.

Where desired, auxiliary roll 49 and pressure roll 51 of roll arrangement 50 can be operated in the same manner as roll arrangement 40, already described in detail, and auxiliary roll 47 and pressure roll 49 of roll arrrangement 48, if desired, can be operated in the same manner as roll arrangement 42. In such case the roll arrangements 48 and 50 are not primarily so operated to closely control the tension roll unit 28 and tension roll unit 26 but because the roll arrangement of the present invention in all instances reduces or eliminates strip slippage and weaving on the rolls of the tension units in the over-all line.

In the operation of the present invention the operator sets out to achieve a constant tension on the strip ahead of the drag tension roll unit 44 or following the drive tension roll unit 46 by adjusting the pressure of the pressure roll 64 or 41, respectively, and by adjusting the electrical characteristics of the pretension roll drag generator 56 or the post-tension roll 41 motor so as to place the desired tension on the entry roll of the drag tension unit 44 or the exit roll of the drive tension unit 46. This results in a constant desired pretension on the entry roll of tension unit 44 and a desired constant post-tension on the exit roll of drive tension unit 46, which tensions are independent of the amount of strip 8 in the associated free-hanging loops. In this way varying lengths of strip in each of the free-hanging loops do not adversely affect the operation of each tensioning unit and the bridle amplification. This in turn results in elimination of strip slippage and strip weaving problems.

In this specification and appended claims where the term "constant" is used in reference to tension on the strip it is to be understood as applying to a situation where the line operation has stabilized.

The above embodiments and variants are to be considered in all respects as illustrative and not restrictive since the invention may be embodied in other specific forms without departing from its spirit or essential characteristics. Therefore, the scope of the invention is indicated by the claims rather than by the foregoing description, and all changes which come within the meaning and range of the equivalents of the claims are intended to be embraced therein.

I claim:

1. In a continuous strip handling apparatus in which there are uncoiling means for withdrawing strip from a coil of the strip at desired strip speeds, coiling means for coiling the strip, strip treating means having an entry end and an exit end between the uncoiling means and the coiling means for carrying out a treatment of the strip which requires tension on the strip controlled independently of the tension on the strip in the remainder of the strip handling apparatus, the combination comprising a. loop forming means for forming a free hanging loop in the strip of varying length of strip on the uncoiling means side of the strip treating means, b. the loop forming means comprising drag strip tensioning roll means on the strip exit side of the free hanging loop for withdrawing strip from the free hanging loop, c. drag generator means associated with the drag strip tensioning roll means for placing controlled back tension on the strip being withdrawn from the loop as the strip moves toward the entry end of the strip treatment means, d. first auxiliary roll means interposed between the free hanging loop and the drag strip tensioning roll means arranged to make continuous surface contact with the strip over an appreciable circumferential surface area of the auxiliary roll means, e. independent drag generator means connected to the first auxiliary roll means for placing back tension on the strip entering the drag strip tensioning roll means, f. independent control means associated with the independent drag generator means for maintaining by means of the first auxiliary roll means a desired back tension on the strip entering the drag strip tensioning roll means, which back tension is independent of the weight of the strip in the loop, g. second loop forming means for forming a second free hanging loop in the strip of varying length on the coiling means side of the strip treating means, h. the second loop forming means comprising drive strip tensioning roll means on the strip entry side of the free hanging loop for pulling strip at controlled speed through the strip treating means and feeding strip into the free hanging loop, i. second auxiliary roll means interposed between the second free hanging loop and the drive strip tensioning roll means arranged to make continuous surface contact with the strip over an appreciable circumferential surface area of the second auxiliary roll means, j. independent driving motor means connected to the second auxiliary roll means for placing pulling tension on the strip leaving the drive strip tensioning roll means, and k. second independent control means associated with the independent driving motor means for maintaining by means of the second auxiliary roll means a desired constant pulling tension on the strip leaving the drive strip tensioning roll means, which pulling tension is independent of the weight of the strip in the loop.

2. The combination of claim 1 including l. pressure roll means for contacting the strip and pressing the strip against the first auxiliary roll means in the area of strip contact with the first auxiliary roll means at a point adjacent to the point where the strip leaves the first auxiliary roll means, and m. power actuated means for controlling the amount of pressure exerted by the pressure roll means on the strip.

3. The combination of claim 2 in which n. the pressure roll means engages only an intermediate portion of the width of the strip not greater than about one-half the width of the widest strip.

4. The combination of claim 3 in which o. the first auxiliary roll means is a rubber covered roll having a plurality of spaced circumferential slits or slots in the periphery thereof in the outer end portions of the roll.

5. The combination of claim 4 including p. second pressure roll means for contacting the strip and pressing the strip against the second auxiliary roll means in the area of strip contact with the second auxiliary roll means at a point adjacent to the point where the strip leaves the second auxiliary roll means, and q. second power actuated means for controlling the amount of pressure exerted by the second pressure roll means on the strip.

6. The combination of claim 5 including r. the second pressure roll means engages only an intermediate portion of the width of the strip not greater than about one-half the width of the widest strip.

7. The combination of claim 6 in which s. the second auxiliary roll means is a rubber covered roll having a plurality of spaced circumferential slits or slots in the periphery thereof in the outer portions of the roll.

8. The combination of claim 4 in which p. the second auxiliary roll means is a rubber covered roll having a plurality of spaced circumferential slits or slots in the periphery thereof in the outer portions of the roll.

9. In the operation of a continuous strip handling apparatus in which there are uncoiling means for withdrawing strip from a coil of the strip at desired strip speeds, coiling meand for coiling the strip, strip treating means having an entry end and an exit end between the uncoiling means and the coiling means for carrying out a treatment of the strip which requires tension on the strip controlled independently of the tension on the strip in the remainder of the strip handling apparatus, loop forming means for forming a free hanging loop in the strip of varying length of strip on the uncoiling means side of the strip treating means, the loop forming means comprising drag strip tensioning roll means on the strip exit side of the free hanging loop for withdrawing strip from the free hanging loop, drag generator control means for placing controlled back tension on the strip being withdrawn from the loop as the strip moves toward the entry end of the strip treatment means, and in which there are second loop forming means for forming a second free hanging loop in the strip of varying length on the coiling side of the strip treating means, the second loop-forming means comprising drive strip tensioning roll means on the strip entry side of the free-hanging loop for pulling strip through the strip treating means and feeding strip into the free-hanging loop while controlling the speed at which the strip is pulled through the strip treating means, the method comprising a. providing a first auxiliary roll means interposed between the free-hanging loop and the drag strip tensioning roll means, b. cause the strip to make continuous surface contact with an appreciable circumferential surface area of the first auxiliary roll means, c. exerting a drag force on the first auxiliary roll means for placing back tension on the strip entering the drag strip tensioning roll means, d. independently controlling the drag force on the first auxiliary roll means to maintain by means of the first auxiliary roll means a desired, constant back tension on the strip entering the drag strip tensioning roll means, which back tension is independent of the weight of the strip in the loop, e. providing a second auxiliary roll means interposed between the second free-hanging loop and the drive strip tensioning roll means, f. causing the strip to make continuous surface contact with an appreciable circumferential surface area of the second auxiliary roll means, g. exerting a driving force on the second auxiliary roll means for placing pulling tension on the strip leaving the drive strip tensioning roll means, and h. independently controlling the driving force on the second auxiliary roll means to maintain by means of the second auxiliary roll means a desired constant pulling tension on the strip leaving the drive strip tension roll means, which pulling tension is independent of the weight of the strip in the loop.

10. The method of claim 9 including i. contacting the strip and pressing the strip against the first auxiliary roll means in the area of strip contact with the first auxiliary roll means by a pressure roll means at a point adjacent to the point where the strip leaves the first auxiliary roll means, the pressure exerted on the strip being controlled to attain in conjunction with the drag force the desired back tension on the strip entering the drag strip tensioning roll means.

11. The method of claim 10 in which j. the pressure of the pressure roll on the strip is limited to an intermediate portion of the width of the strip not greater than about one-half the width of the widest strip.

12. The method of claim 9 including i. contacting the strip and pressing the strip against the second auxiliary roll means in the area of strip contact with the second auxiliary roll means by a second pressure roll means at a point adjacent to the point where the strip leaves the second auxiliary roll means, the pressure exerted on the strip being controlled to attain in conjunction with the driving force the desired pulling tension on the strip leaving the drive strip tensioning roll means.

13. The method of claim 12 in which j. the pressure of the second pressure roll on the strip is limited to an intermediate portion of the width of the strip not greater than about one-half the width of the widest strip.

* * * * *